US012070172B2

(12) United States Patent
Xue et al.

(10) Patent No.: US 12,070,172 B2
(45) Date of Patent: Aug. 27, 2024

(54) SPRAYING APPARATUS AND DISH-WASHING MACHINE

(71) Applicants: GUANGDONG MIDEA WHITE HOME APPLIANCE TECHNOLOGY INNOVATION CENTER CO., LTD., Foshan (CN); MIDEA GROUP CO., LTD., Foshan (CN)

(72) Inventors: Weijun Xue, Foshan (CN); Chubin Ou, Foshan (CN); Fagang Tan, Foshan (CN); Shouliang Gu, Foshan (CN); Fangzhen Zheng, Foshan (CN)

(73) Assignees: GUANGDONG MIDEA WHITE HOME APPLIANCE TECHNOLOGY INNOVATION CENTER CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 514 days.

(21) Appl. No.: 17/285,083

(22) PCT Filed: Dec. 21, 2018

(86) PCT No.: PCT/CN2018/122630
§ 371 (c)(1),
(2) Date: Mar. 15, 2022

(87) PCT Pub. No.: WO2020/077816
PCT Pub. Date: Apr. 23, 2020

(65) Prior Publication Data

US 2022/0233051 A1 Jul. 28, 2022

(30) Foreign Application Priority Data

Oct. 16, 2018 (CN) ..... 201811207855.6

(51) Int. Cl.
*A47L 15/22* (2006.01)
*A47L 15/42* (2006.01)

(52) U.S. Cl.
CPC ..... *A47L 15/22* (2013.01); *A47L 15/4217* (2013.01); *A47L 15/4225* (2013.01);
(Continued)

(58) Field of Classification Search
None
See application file for complete search history.

(56) References Cited

U.S. PATENT DOCUMENTS 5,415,350 A 5/1995 Yoon et al.
2017/0265707 A1* 9/2017 Roderick ..... A47L 15/4287

FOREIGN PATENT DOCUMENTS

CN 2263147 Y 9/1997
CN 101301187 A 11/2008
(Continued)

OTHER PUBLICATIONS

First Office Action issued on May 31, 2022 regarding Japanese Patent Application No. 2021-543552.
(Continued)

*Primary Examiner* — Levon J Shahinian

(57) ABSTRACT

A spraying apparatus and a dish-washing machine. The spraying apparatus comprises: a spraying pipe, a water injection nozzle being provided on the spraying pipe; a drive mechanism, the drive mechanism comprising a driving gear and a driven gear engaging with the driving gear, and the driven gear being connected to the spraying pipe to drive the spraying pipe to rotate; a driving mechanism, the driving mechanism being connected to the driving gear to drive the driving gear to rotate. The rotation of the spraying pipe in the spraying apparatus is stable and reliable, and control precision of a spraying region is high.

10 Claims, 7 Drawing Sheets

(52) U.S. Cl.
CPC ..... *A47L 15/4278* (2013.01); *A47L 15/428* (2013.01); *A47L 15/4282* (2013.01)

(56) References Cited

FOREIGN PATENT DOCUMENTS

| | | | |
|---|---|---|---|
| CN | 202446038 | U | 9/2012 |
| CN | 103284674 | A | 9/2013 |
| CN | 204293091 | U | 4/2015 |
| CN | 104720711 | A | 6/2015 |
| CN | 104814710 | A | 8/2015 |
| CN | 106073675 | A | 11/2016 |
| CN | 106419794 | A | 2/2017 |
| CN | 205924989 | U | 2/2017 |
| CN | 206675491 | U | 11/2017 |
| CN | 107597769 | A | 1/2018 |
| CN | 108078525 | A | 5/2018 |
| CN | 209122118 | U | 7/2019 |
| EP | 2441370 | A2 | 4/2012 |
| EP | 3834694 | A1 | 6/2021 |
| JP | H01284355 | A | 11/1989 |
| JP | H0229658 | U | 2/1990 |
| JP | H02220625 | A | 9/1990 |
| JP | H0468760 | U | 6/1992 |
| JP | H0910159 | A | 1/1997 |
| KR | 940009391 | U | 5/1994 |
| KR | 20100075220 | A | 7/2010 |
| KR | 20100137741 | A | 12/2010 |
| KR | 20150009399 | A | 1/2015 |
| KR | 20160149409 | A | 12/2016 |
| WO | 2017185891 | A1 | 11/2017 |

OTHER PUBLICATIONS

Supplementary European search report of EP Application No. 18936967.1.
First OA received in CN Application No. 201811207855.6; mailed Apr. 1, 2024.
Notice of Allowance received in CN Application No. 201811207855.6; mailed May 13, 2024.

* cited by examiner

SPRAYING APPARATUS AND DISH-WASHING MACHINE

CROSS-REFERENCES TO RELATED APPLICATIONS

The present disclosure is a national phase application of International Application No. PCT/CN2018/122630, filed on Dec. 21, 2018, which claims priority to Chinese Patent Application No. 201811207855.6, filed on Oct. 16, 2018, the entireties of which are herein incorporated by reference.

FIELD

The present disclosure relates to the field of a dish-washing machine, and in particular to a spray washer and a dish-washing machine.

BACKGROUND

Currently, the spraying structure of the dish-washing machine in the market usually rotates by an elongate spraying arm structure. Since the rotation of the spraying arm is driven by a motor, the rotation angle of the spraying arm during rotation is difficult to be accurately controlled, which is not conductive to accurate spray washing of the tableware with the water sprayed by the spraying arm, so that the utilization of water is decreased.

SUMMARY

Embodiments of the present disclosure are to provide a spray washer, which is intended to improve the rotation accuracy of spraying pipes, to increase the utilization of water.

In some embodiment, a spray washer proposed in the present disclosure includes:

at least one spraying pipe provided with at least one water injection nozzle;

a transmission mechanism including a driving gear and a driven gear meshing with the driving gear, the driven gear being connected to the spraying pipe to drive the spraying pipe into rotation; and a driving mechanism connected to the driving gear to drive the driving gear into rotation.

In one embodiment, the power source includes a driving motor. The driving gear is fixedly connected to a rotating shaft of the driving motor.

In one embodiment, the spray washer includes a plurality of spraying pipes. The spray washer further includes a first transmission wheel and a first linkage.

One end of one of the spraying pipes is connected to the first transmission wheel, and another end of the spraying pipe is in communication with a water source.

One end of the first linkage is hinged to the driven gear, and another end of the first linkage is hinged to the first transmission wheel, to drive the spraying pipe and the first transmission wheel into rotation with rotation of the driven gear.

In one embodiment, the spraying pipe is connected to a middle portion of the first transmission wheel.

One end of the first linkage is connected to an upper portion or a lower portion of the first transmission wheel, and another end of the first linkage is connected to an upper portion or a lower portion of the driven gear.

In one embodiment, the spray washer further includes a second transmission wheel and a second linkage.

One end of one of the spraying pipes is connected to the second transmission wheel, and another end of the spraying pipe is in communication with the water source.

One end of the second linkage is hinged to the first transmission wheel, and another end of the second linkage is hinged to the second transmission wheel, to drive the spraying pipe and the second transmission wheel into rotation with the rotation of the first transmission wheel.

In one embodiment, the spraying pipe is connected to a middle portion of the second transmission wheel.

Said one end of the second linkage is connected to an upper portion or a lower portion of the first transmission wheel, and said another end of the second linkage is connected to an upper portion or a lower portion of the second transmission wheel.

In one embodiment, the spray washer includes a water supply assembly. The water supply assembly includes a water pump, a water feeding pipe and a plurality of water distributing pipes.

One end of the water feeding pipe is in communication with the water pump, and another end of the water feeding pipe is in communication with water distributing pipes.

One end of each water distributing pipe away from the water feeding pipe is in communication with one of the spraying pipes.

In one embodiment, the water supply assembly is located below the spraying pipes, and each water distributing pipe is arranged around the water feeding pipe after being bent.

In one embodiment, the spray washer further includes a reinforcing plate. The reinforcing plate is connected to the water distributing pipes along an arrangement direction of the water distributing pipes, and is provided with a fixing portion for fixing the reinforcing plate.

In one embodiment, a rotation angle between an initial rotation position and an end rotation position of each spraying pipe is comprised between 100° and 150°.

The present disclosure further provides a dish-washing machine. The dish-washing machine includes:

an inner container provided with a receiving chamber; and a spray washer arranged within the receiving chamber.

Herein, the spray washer includes:

at least one spraying pipe provided with at least one water injection nozzle;

a transmission mechanism including a driving gear and a driven gear meshing with the driving gear, the driven gear being connected to the spraying pipe to drive the spraying pipe into rotation; and a driving mechanism connected to the driving gear to drive the driving gear into rotation.

In one embodiment, the dish-washing machine includes a bowl basket arranged within the inner container.

Each spraying pipe is provided with a plurality of water injection nozzles, which are arranged along a length direction of each spraying pipe corresponding to a position of the bowl basket.

In some embodiment of the present disclosure, the driving force of the driving mechanism is transmitted to the spraying pipes through the driving gear and the driven gear, so that the spraying pipes rotate along an axial axis thereof, and water is sprayed from the water injection nozzles on each spraying pipe. During the rotation of the spraying pipes, a spray washing area is formed. Since the spraying pipes are driven by a gear structure, both the rotation of the spraying pipes and the transmission of power are very stable and reliable. Meanwhile, the rotation angle of each spraying pipe can be accurately controlled, to control the change of the spray washing area, so that the spray washer can accurately control the spraying area, which facilitates improving the accuracy of the spray washer for spray washing the tableware, and increasing the utilization of water and cleaning efficiency.

BRIEF DESCRIPTION OF THE DRAWINGS

In order to more clearly illustrate the embodiments of the present disclosure, the drawings required for describing the embodiments or the prior art will be briefly discussed below, and the drawings in the following description are merely some embodiments of the present disclosure.

EXPLANATION OF REFERENCE NUMERAL

TABLE 1

Figure 1:
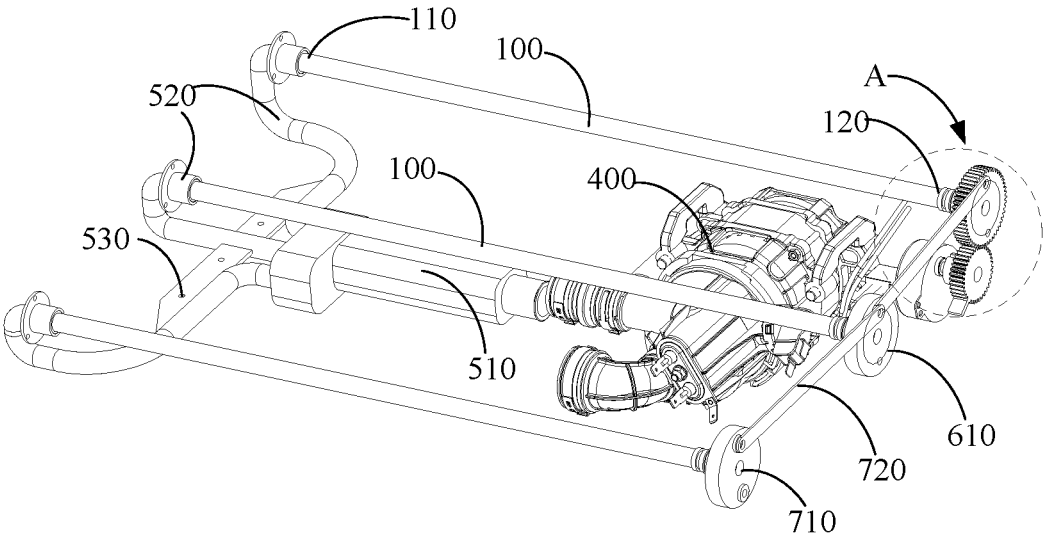
FIG. 1 is a schematic diagram of one embodiment of a spray washer of the present disclosure.

| Reference numerals | Name | Reference numerals | Name |
|---|---|---|---|
| 100 | spraying pipe | 110 | water inlet end |
| 120 | driving end | 200 | driving mechanism |
| 300 | transmission mechanism | 310 | driving gear |
| 320 | driven gear | 110 | water pump |
| 510 | water feeding pipe | 400 | water distributing pipe |
| 530 | reinforcing plate | 520 | first transmission wheel |
| 620 | first linkage | 610 | second transmission wheel |
| 720 | second linkage | 710 | |

The realizing of the aim, functional characteristics of the present disclosure are further described in detail with reference to the accompanying drawings and the embodiments.

DETAILED DESCRIPTION OF THE DISCLOSURE

In embodiments of the disclosure are clearly and fully described below with reference to the accompanying drawings in the embodiments of the disclosure. Apparently, the described embodiments are merely some of the embodiments of the disclosure, but not all the embodiments.

It should be understand that, all directional indications (such as "upper", "lower", "left", "right", "front", "back" . . . ) in the embodiments of the present disclosure are only used to explain the relative positional relationship, motion, and the like, between components in a posture. If the particular posture changes, the directional indication changes accordingly.

In addition, if there are descriptions of "first" and "second" in the embodiments of the present disclosure, the descriptions of "first" and "second" are used for descriptive purposes only and cannot be appreciated as indicating or implying their relative importance or implicitly indicating the number of indicated features. Thus, features defining "first" and "second" may explicitly or implicitly include at least one such feature.

The present disclosure mainly provides a spray washer, which is mainly applied to a dish-washing machine, to increase the utilization of water and the tableware cleaning efficiency of the dish-washing machine.

The structure of the spray washer will be mainly described below.

Figure 2:
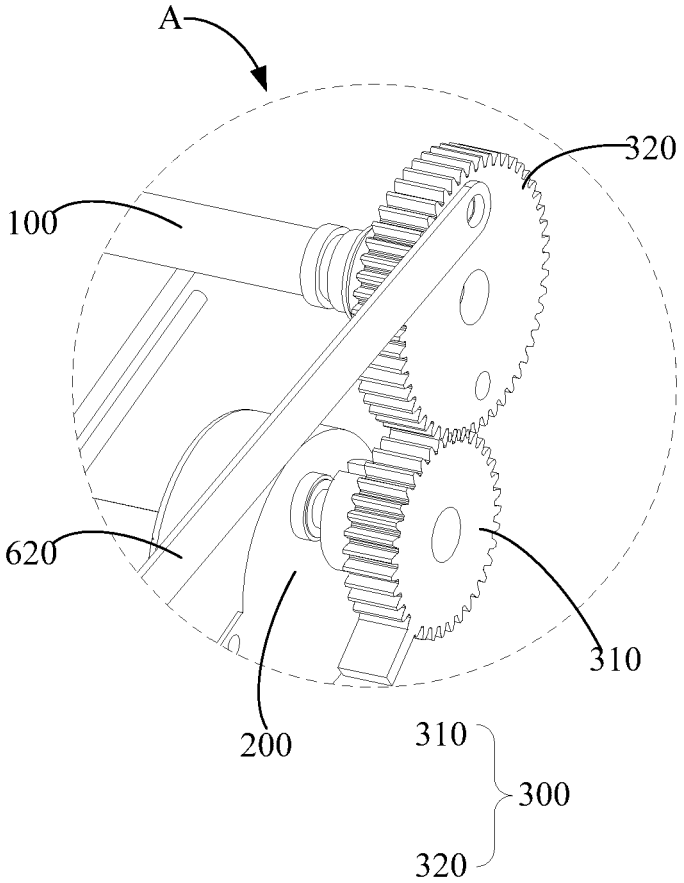
FIG. 2 is a partially enlarged view of a part A in FIG. 1.
Figure 3:
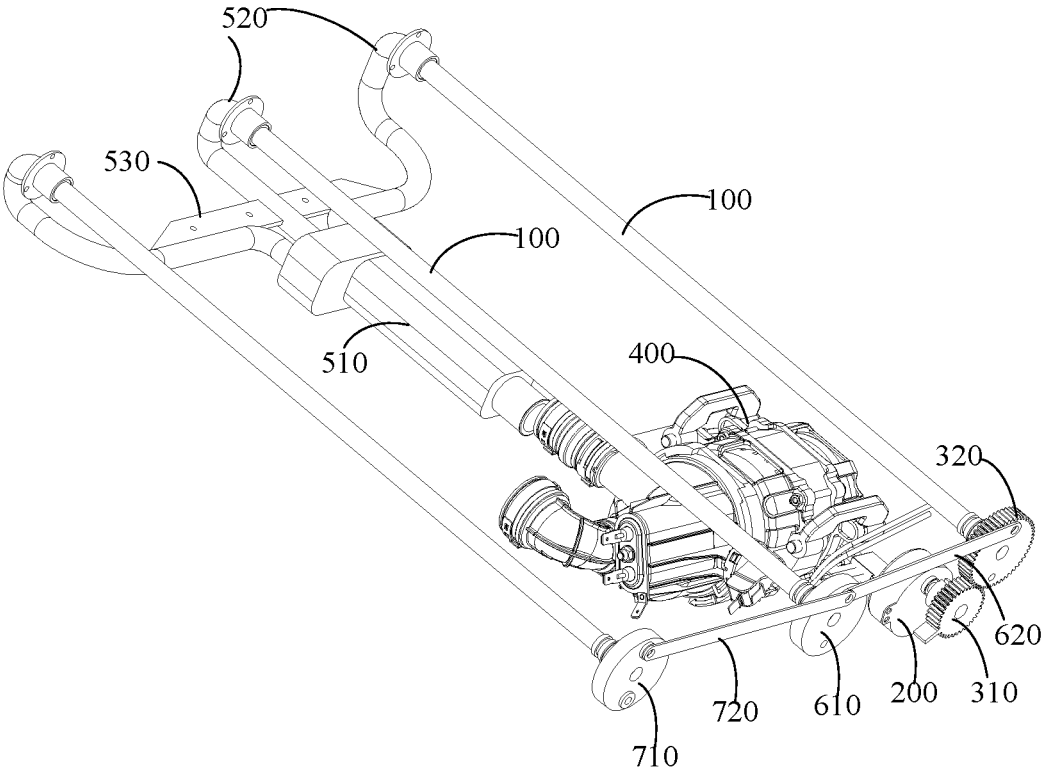
FIG. 3 is a schematic diagram of another embodiment of a spray washer of the present disclosure.
Figure 4:
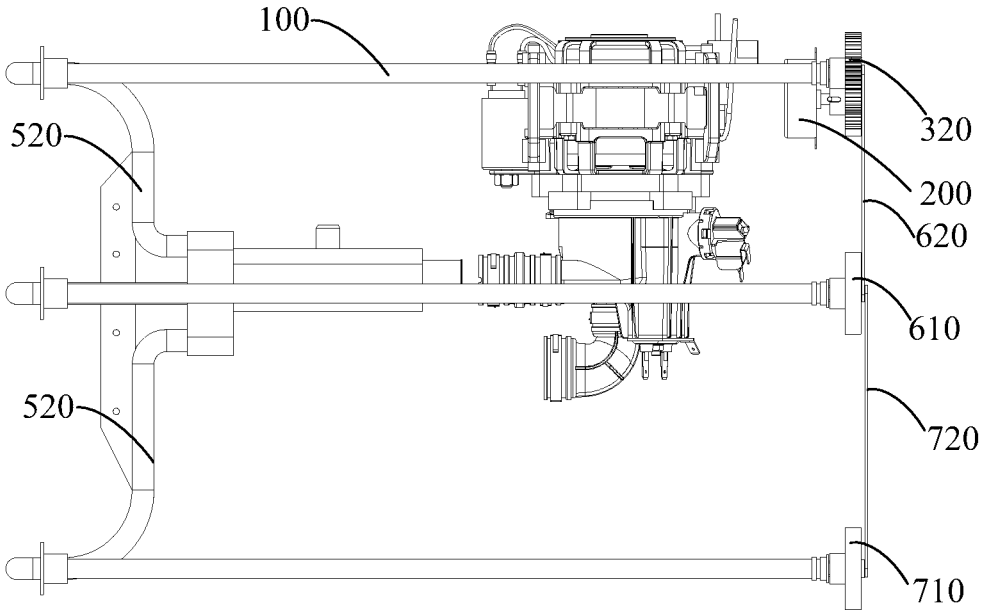
FIG. 4 is a schematic diagram of still another embodiment of a spray washer of the present disclosure.
Figure 5:
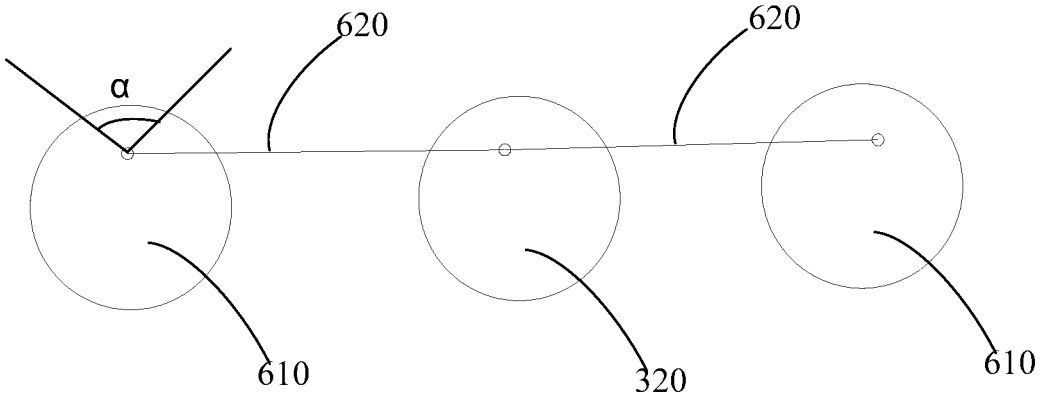
FIG. 5 is a schematic diagram of one embodiment of an arrangement of a driven gear and a first transmission wheel of a spray washer of the present disclosure.
Figure 6:
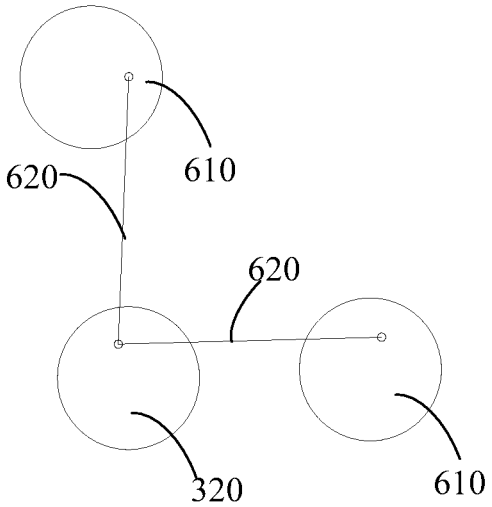
FIG. 6 is a schematic diagram of another embodiment of an arrangement of a driven gear and a first transmission wheel of a spray washer of the present disclosure.
Figure 7:
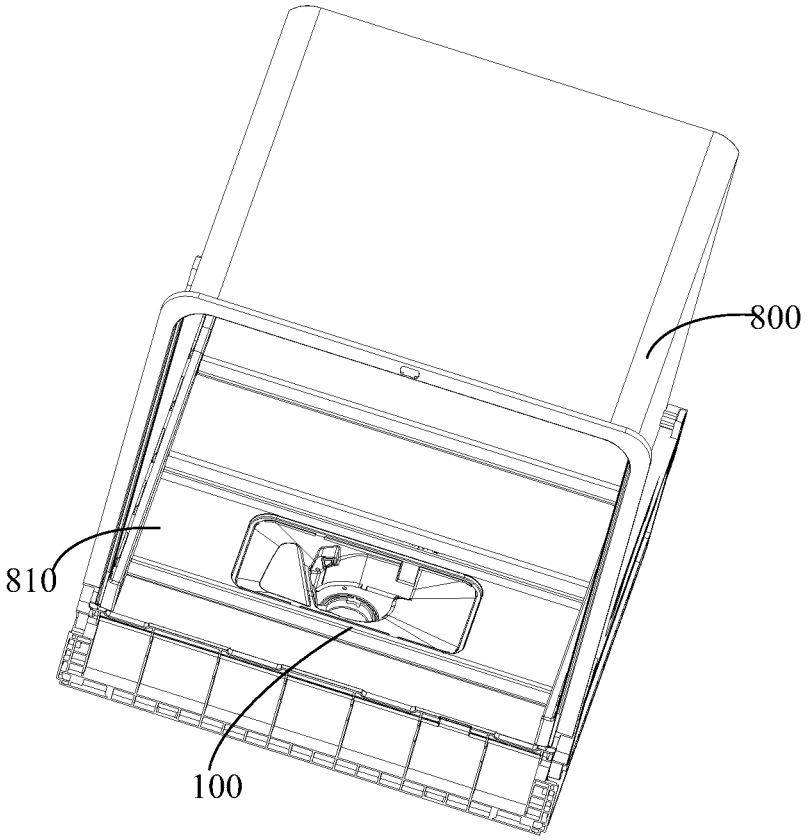
FIG. 7 is a schematic diagram of one embodiment of a dish-washing machine of the present disclosure.

Referring to FIG. 1 to FIG. 7, in an embodiment of the present disclosure, the spray washer includes:

- at least one spraying pipe 100, the spraying pipe 100 being provided with at least one water injection nozzle;
- a transmission mechanism including a driving gear 310 and a driven gear 320 meshing with the driving gear 310, the driven gear 320 being connected to the spraying pipe 100 to drive the spraying pipe 100 into rotation; and
- a driving mechanism 200 connected to the driving gear 310 to drive the driving gear 310 into rotation.

In this embodiment, the spraying pipe 100 is configured as a columnar pipe. The spraying pipe includes a water inlet end 110 and a driving end 120. That is, the water inlet structure of the spraying pipe 100 is provided at one end of the spraying pipe 100 and the driving structure of the spraying pipe 100 is provided at another end of the spraying pipe 100, so that the driving structure and the water inlet structure do not interfere with each other. Of course, in some embodiments, in order to save space, the driving structure and the water inlet structure may also be provided at the same end of the spraying pipe 100. The driving end 120 of the spraying pipe 100 is closed, and the water is discharged from the water injection nozzle after the water enters from the water inlet end 110. The water injection nozzle is provided on the pipe wall of the spraying pipe 100, so that the water flow may be directly sprayed from the water injection nozzle. In one embodiment, a sprinkler may also be installed in the water injection nozzle, so that the water may be sprayed from the sprinkler.

The driven gear 320 may be directly provided around the driving end 120. Of course, in some embodiments, a driven shaft can be provided on the driving end, and the driven gear 320 is provided around the driven shaft. The axis of rotation of the driven gear 320 is collinear with the axial axis of the spraying pipe 100. The driving gear 310 meshes with the driven gear 320. There may be a plurality of positions of the driving gear with respect to the driven gear 320, such as, above, below, at the left side, or at the right side. The position that the driving gear is located below the driven gear 320 is taken as an example. Taking an upward spraying direction as an example, the driving gear 310 is arranged below the driven gear to avoid affecting the cleaning of the tableware. Herein, the driving gear 310 and the driven gear 320 are both spur gears.

There are many forms of driving structures, such as motors, impellers, fuel engines, etc. The driving mechanism 200 has a driving shaft. The driving shaft is directly inserted into the driving gear 310, or connected to the driving gear 310 after being decelerated by the transmission structure 300. The driving gear 310 rotates through the driving shaft as a rotating shaft. The driving mechanism 200 takes a driving motor as an example, the driving gear 310 is fixedly connected to the rotating shaft of the driving motor.

In this embodiment, the driving force of the driving mechanism 200 is transmitted to the spraying pipe 100 through the driving gear 310 and the driven gear 320, so that the spraying pipe 100 rotates along an axial axis thereof, and water is sprayed from the water injection nozzle on the spraying pipe 100. During the rotation of the spraying pipe 100, a spray washing area is formed. Since the spraying pipe 100 is driven by a gear structure, both the rotation of the spraying pipe 100 and the transmission of power are very stable and reliable. Meanwhile, the rotation angle of the spraying pipe 100 can be accurately controlled, to control the change of the spray washing area, so that the spray washer can accurately control the spraying area, which facilitates improving the accuracy of the spray washer for spray washing the tableware, and increasing the utilization of water and cleaning efficiency.

It should be noted that, in order to ensure the range of the water feeding area, the rotation angle $\alpha$ of the spraying pipe 100 is from 100° to 150°, taking from 120° to 140° as an example. By setting the rotation angle of the spraying pipe 100 as a range from 100° to 150°, it can avoid that if the angle is too large, the spraying pressure is not enough to clean; if the angle is too small, the area covered by the spraying pipe 100 is too small to cover the entire area required for cleaning.

In order to improve the driving efficiency of the driving structure, the spray washer includes a plurality of spraying pipes 100. The spray washer further includes a first transmission wheel 610 and a first linkage 620. One end of one of the spraying pipes 100 is connected to the first transmission wheel 610, and another end of the spraying pipe is in communication with a water source. One end of the first linkage 620 is hinged to the driven gear 320, and another end of the first linkage is hinged to the first transmission wheel 610, to drive the spraying pipe 100 and the first transmission wheel into rotation with rotation of the driven gear 320.

In this embodiment, the spraying pipes 100 may be positioned at the front side, the rear side or on the top of the spraying pipe 100 connected to the driven gear 320. In some embodiments, the spray washer includes a plurality of first linkages 620 and a plurality of first transmission wheels 610 connected to the first linkages 620. In this case, one driven gear 320 may simultaneously drive the plurality of first transmission wheel 610, to simultaneously drive the plurality of spraying pipes 100. One first transmission linkage and one first transmission wheel 610 are described in detail below.

One end of the first linkage 620 is hinged to the driven gear 320, so that the first linkage 620 rotates with the rotation of the driven gear 320. Another end of the first linkage 620 is hinged to the first transmission wheel 610, so that the first linkage 620 transmits the rotation displacement of the driven gear 320 to the first transmission wheel 610, the first transmission wheel 610 converts the displacement of the first linkage 620 into the rotation displacement, and finally transmits the rotation displacement to the spraying pipes 100. As a result, the spraying pipes 100 rotate with rotation of the driven gear 320.

In some embodiments, in order to better drive the spraying pipes 100, one of the spraying pipes 100 is connected to a middle portion of the first transmission wheel 610. One end of the first linkage 620 is connected to an upper portion or a lower portion of the first transmission wheel 610, and another end of the first linkage is connected to an upper portion or a lower portion of the driven gear 320. Herein, the connection between the spraying pipe 100 and the first transmission wheel 610 is similar to the connection between the driven gear 320 and the spraying pipe 100. The axis of rotation of the first transmission wheel is collinear with the axis of rotation of the spraying pipe 100. One end of the first linkage 620 is hinged to the top of the first transmission wheel 610, and another end of the first linkage is hinged to the top of the driven gear 320. In this case, the rotation direction of the first transmission wheel 610 is the same as the rotation direction of the driven gear 320. When one end of the first linkage 620 is hinged to the bottom of the first transmission wheel 610, and another end of the first linkage is hinged to the top of the driven gear 320, the rotation direction of the first transmission wheel 610 is opposite to the rotation direction of the driven gear 320.

In order to further increase the driving efficiency of the driving mechanism, the spray washer further includes a second transmission wheel 710 and a second linkage 720. One end of one of the spraying pipes 100 is connected to the second transmission wheel 720, and another end of the spraying pipe is in communication with the water source. One end of the second linkage 720 is hinged to the first transmission wheel 610, and another end of the second linkage is hinged to the second transmission wheel 710, to drive the spraying pipe 100 and the second transmission wheel into rotation with the rotation of the first transmission wheel.

In this embodiment, the second transmission wheel 710 is located on the top of the first transmission wheel 610, or at a side of the first transmission wheel away from the driven gear 320. The spray washer includes a plurality of second transmission wheels 710 and a plurality of second linkages 720. In this case, one first transmission wheel 610 may simultaneously drive the plurality of second transmission wheels 710. One second transmission linkage and one second transmission wheel 710 are described in detail below.

One end of the second linkage 720 is hinged to the first transmission wheel 610, so that the second linkage 720 rotates with the rotation of the first transmission wheel 610. Another end of the second linkage 720 is hinged to the second transmission wheel 710, so that the second linkage 720 transmits the rotation displacement of the first transmission wheel 610 to the second transmission wheel 710, the second transmission wheel 710 converts the displacement of the second linkage 720 into the rotation displacement, and finally transmits the rotation displacement to the spraying pipes 100. As a result, the spraying pipes 100 rotate with rotation of the first transmission wheel 610.

In some embodiments, in order to better drive the spraying pipes 100, the spraying pipe 100 is connected to a middle portion of the second transmission wheel 710. One end of the second linkage 720 is connected to an upper portion or a lower portion of the first transmission wheel 610, and another end of the second linkage is connected to an upper portion or a lower portion of the second transmission wheel.

Herein, the connection between the spraying pipe 100 and the second transmission wheel 710 is similar to the connection between the first transmission wheel 610 and the spraying pipe 100. The axis of rotation of the second transmission wheel 710 is collinear with the axis of rotation of the spraying pipe 100. One end of the second linkage 720 is hinged to the top of the second transmission wheel 710, and another end of the second linkage is hinged to the top of the first transmission wheel 610. In this case, the rotation direction of the second transmission wheel 710 is the same as the rotation direction of the first transmission wheel 610. When one end of the second linkage 720 is hinged to the bottom of the second transmission wheel 710, and another end of the second linkage is hinged to the top of the first transmission wheel 610, the rotation direction of the second transmission wheel 710 is opposite to the rotation direction of the first transmission wheel 610.

In order to supply sufficient water to the spraying pipes 100, the spray washer includes a water supply assembly. The water supply assembly includes a water pump 400, a water feeding pipe 510 and a plurality of water distributing pipes 520. One end of the water feeding pipe 510 is in communication with the water pump 400, and another end of the water feeding pipe is in communication with water distributing pipes 520. One end of each water distributing pipe 520 away from the water feeding pipe 510 is in communication with one of the spraying pipes 100. One end of the water feeding pipe 510 is in communication with the water pump 400, and another end of the water feeding pipe is in communication with the water distributing pipes 520. The water pump 400 pumps water from the water source to the water feeding pipe 510, and then the water feeding pipe 510 delivers water to the water distributing pipes 520. One end of each water distributing pipe 520 away from the water feeding pipe 510 is in communication with one of the spraying pipes 100. There are many ways of communication, such as surrounding, adapting through adapters, etc.

Herein, the water supply assembly is located below the spraying pipes 100, and each water distributing pipe 520 is arranged around the water feeding pipe 510 after being bent. When the spraying pipes 100 spray water upwardly, the water supply assembly below does not affect the spray washing of the spraying pipes 100, which ensures the effect of spray washing while fully utilizing the space.

In some embodiments, in order to improve the installation stability of the water feeding assembly and reduce the vibration noise, the spray washer further includes a reinforcing plate 530. The reinforcing plate 530 is connected to the water distributing pipes 520 along an arrangement direction of the water distributing pipes 520, and is provided with a fixing portion for fixing the reinforcing plate 530. The reinforcing plate 530 is fixedly connected to the inner container, so that the reinforcing plate 530 not only strengthens the strength and stability of the water distributing pipes 520, but also prevents the water distributing pipes 520 from swinging and vibrating greatly due to the impact of water flow by fixing the water distributing pipes 520, and effectively reducing the noise generated by the swinging and vibrating of the water distributing pipes 520.

The present disclosure further provides a dish-washing machine. The dish-washing machine includes an inner container and a spray washer. The structure of the spray washer refers to the above embodiments. Since the dish-washing machine adopts all of the above embodiments, the dish-washing machine at least has all the beneficial effects brought by the above embodiments, which is not repeated here. Herein, the inner container has a receiving chamber, within which the spray washer is arranged.

In order to improve the spray washing efficiency and effect of the spraying pipes 100, the dish-washing machine includes a bowl basket arranged within the inner container. Each spraying pipe 100 is provided with a plurality of water injection nozzles, which are arranged along a length direction of each spraying pipe 100 corresponding to a position of the bowl basket. The water injection nozzles are arranged corresponding to the bowl basket, so that the water flow sprayed from the water injection nozzles can be accurately sprayed onto the bowl basket, to improve the efficiency of cleaning the tableware in the bowl basket.

What is claimed is:

1. A spray washer, comprising:

at least one spraying pipe provided with at least one water injection nozzle;

a transmission mechanism comprising a driving gear and a driven gear meshing with the driving gear, the driven gear being connected to the at least one spraying pipe to drive the at least one spraying pipe into rotation; and a driving mechanism connected to the driving gear to drive the driving gear into rotation;

wherein the spray washer comprises a water supply assembly, the water supply assembly comprising a water pump, a water feeding pipe and a plurality of water distributing pipes;

wherein one end of the water feeding pipe is in communication with the water pump, and another end of the water feeding pipe is in communication with the water distributing pipes; and wherein one end of each water distributing pipe away from the water feeding pipe is in communication with one of the at least one spraying pipes.

2. The spray washer of claim 1, wherein the spray washer comprises a plurality of spraying pipes, and further comprises a first transmission wheel and a first linkage; and wherein one end of one of the spraying pipes is connected to the first transmission wheel, and another end of the at least one spraying pipe is in communication with a water source; and wherein one end of the first linkage is hinged to the driven gear, and another end of the first linkage is hinged to the first transmission wheel, to drive the at least one spraying pipe and the first transmission wheel into rotation with rotation of the driven gear.

3. The spray washer of claim 2, wherein the at least one spraying pipe is connected to a middle portion of the first transmission wheel; and wherein one end of the first linkage is connected to an upper portion or a lower portion of the first transmission wheel, and another end of the first linkage is connected to an upper portion or a lower portion of the driven gear.

4. The spray washer of claim 2, wherein the spray washer further comprises a second transmission wheel and a second linkage;

wherein one end of one of the spraying pipes is connected to the second transmission wheel, and another end of the at least one spraying pipe is in communication with the water source; and wherein one end of the second linkage is hinged to the first transmission wheel, and another end of the second linkage is hinged to the second transmission wheel, to drive the at least one spraying pipe and the second transmission wheel into rotation with the rotation of the first transmission wheel.

5. The spray washer of claim 4, wherein the at least one spraying pipe is connected to a middle portion of the second transmission wheel; and wherein said one end of the second linkage is connected to an upper portion or a lower portion of the first transmission wheel, and said another end of the second linkage is connected to an upper portion or a lower portion of the second transmission wheel.

6. The spray washer of claim 1, wherein the water supply assembly is located below the at least one spraying pipes, and each water distributing pipe is arranged around the water feeding pipe after being bent.

7. The spray washer of claim 1, wherein the spray washer further comprises a reinforcing plate, which is connected to the water distributing pipes along an arrangement direction of the water distributing pipes, and which is provided with a fixing portion for fixing the reinforcing plate.

8. The spray washer of claim 1, wherein a rotation angle between an initial rotation position and an end rotation position of each of the at least one spraying pipe is comprised between 100° and 150°.

9. A dish-washing machine, comprising:

an inner container provided with a receiving chamber; and a spray washer, wherein the spray washer is arranged within the receiving chamber;

wherein the spray washer comprises:

at least one spraying pipe provided with at least one water injection nozzle;

a transmission mechanism comprising a driving gear and a driven gear meshing with the driving gear, the driven gear being connected to the at least one spraying pipe to drive the at least one spraying pipe into rotation; and a driving mechanism connected to the driving gear to drive the driving gear into rotation;

wherein the spray washer comprises a water supply assembly, the water supply assembly comprising a water pump, a water feeding pipe and a plurality of water distributing pipes;

wherein one end of the water feeding pipe is in communication with the water pump, and another end of the water feeding pipe is in communication with the water distributing pipes; and wherein one end of each water distributing pipe away from the water feeding pipe is in communication with one of the at least one spraying pipes.

10. The dish-washing machine of claim 9, wherein the dish-washing machine comprises a bowl basket arranged within the inner container; and wherein each of the at least one spraying pipe is provided with a plurality of water injection nozzles, which are arranged along a length direction of each of the at least one spraying pipe corresponding to a position of the bowl basket.

* * * * *